US008731426B2

(12) United States Patent
Shimazawa

(10) Patent No.: US 8,731,426 B2
(45) Date of Patent: May 20, 2014

(54) INFORMATION INPUT APPARATUS AND IMAGE FORMING APPARATUS

(75) Inventor: Yohichi Shimazawa, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 1282 days.

(21) Appl. No.: 11/370,479

(22) Filed: Mar. 7, 2006

(65) Prior Publication Data

US 2006/0216053 A1 Sep. 28, 2006

(30) Foreign Application Priority Data

Mar. 25, 2005 (JP) ..... 2005-087881

(51) Int. Cl.
*G03G 15/00* (2006.01)

(52) U.S. Cl.
USPC ..... 399/80; 399/81

(58) Field of Classification Search
USPC ..... 399/80, 81, 82, 410; 700/17; 345/173; 726/19
See application file for complete search history.

(56) References Cited

U.S. PATENT DOCUMENTS

| | | | | |
|---|---|---|---|---|
| 5,270,775 | A * | 12/1993 | Suzuki | 399/8 |
| 6,549,194 | B1 * | 4/2003 | McIntyre et al. | 345/173 |
| 6,795,663 | B2 * | 9/2004 | Kato | 399/81 |
| 2002/0196238 | A1 * | 12/2002 | Tsukada et al. | 345/173 |
| 2003/0182558 | A1 * | 9/2003 | Lazzaro et al. | 713/183 |
| 2004/0080529 | A1 * | 4/2004 | Wojcik | 345/738 |
| 2005/0122540 | A1 * | 6/2005 | Kadowaki | 358/1.15 |
| 2005/0251752 | A1 * | 11/2005 | Tan et al. | 715/741 |

FOREIGN PATENT DOCUMENTS

| | | | |
|---|---|---|---|
| JP | 03025569 | A * | 2/1991 |
| JP | 07-180408 | | 7/1995 |
| JP | 08-095659 | | 4/1996 |
| JP | 08-249284 | | 9/1996 |
| JP | 11-133816 | | 5/1999 |
| JP | 11-327744 | | 11/1999 |
| JP | 2000-108453 | | 4/2000 |
| JP | 2002-229948 | | 8/2002 |
| JP | 2004-038407 | | 2/2004 |
| JP | 2004-214812 | | 7/2004 |
| JP | 2005-018569 | | 1/2005 |

* cited by examiner

*Primary Examiner* — Walter L Lindsay, Jr.
*Assistant Examiner* — Jessica L Eley
(74) *Attorney, Agent, or Firm* — Edwards Wildman Palmer LLP; David G. Conlin; Steven M. Jensen

(57) ABSTRACT

An information input apparatus is constituted of an operation panel that inputs various types of information and an operation panel board that controls the operation panel. The operation panel includes an LCD that is the displaying unit that displays the information input screen for inputting various types of information, and a touch panel that is the input instructing unit that executes an input instruction from an input region (virtual keys) provided on the information input screen. The LCD displays on the virtual keys information different from information previously assigned to the virtual keys on the information input screen.

6 Claims, 6 Drawing Sheets

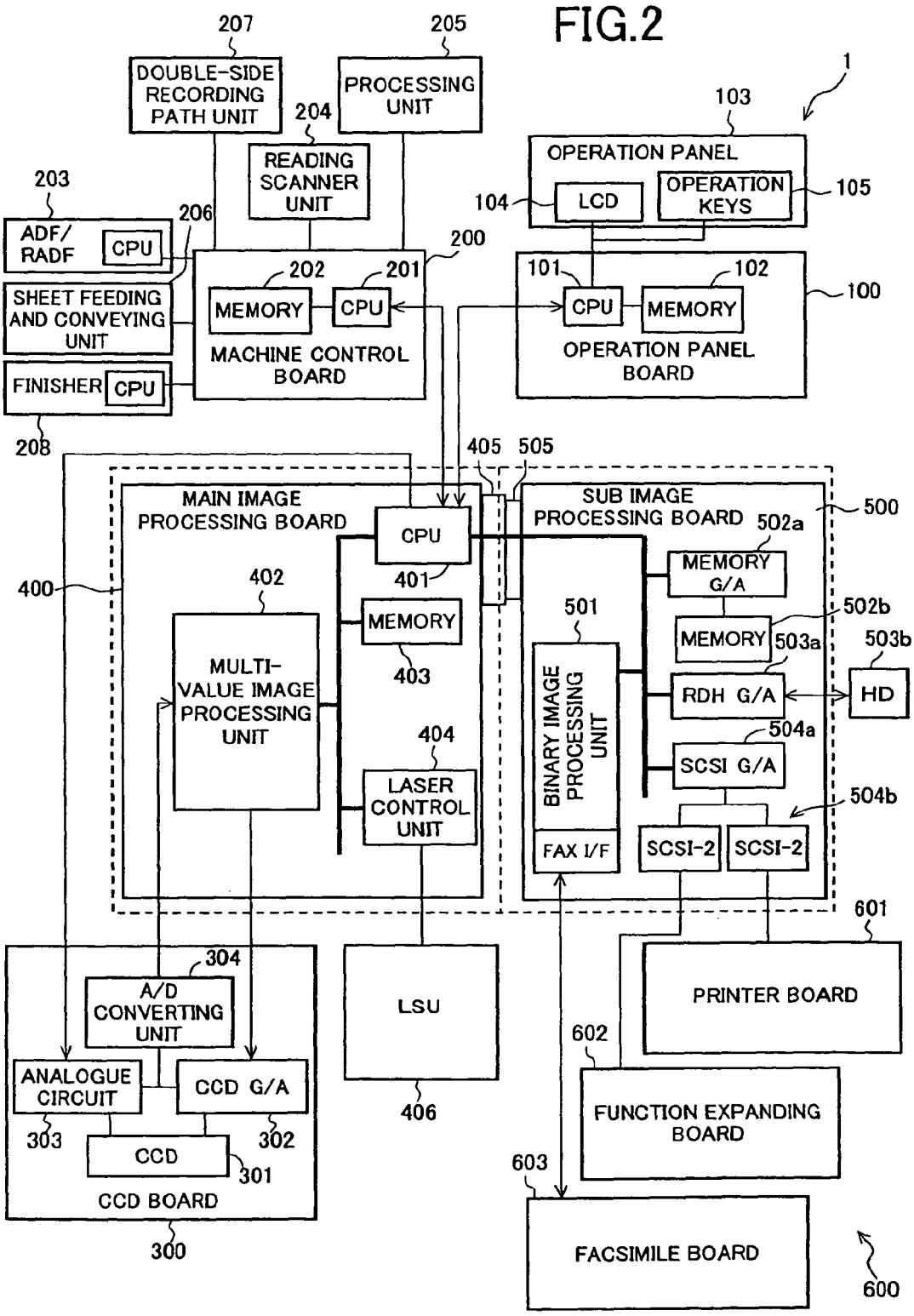
FIG.2
1
207
DOUBLE-SIDE RECORDING PATH UNIT
205
PROCESSING UNIT
204
READING SCANNER UNIT
103
OPERATION PANEL
104
LCD
OPERATION KEYS
105
203
ADF/ RADF
CPU
206
200
202
201
MEMORY
CPU
MACHINE CONTROL BOARD
SHEET FEEDING AND CONVEYING UNIT
FINISHER
CPU
208
101
102
CPU
MEMORY
OPERATION PANEL BOARD
100
405
505
MAIN IMAGE PROCESSING BOARD
CPU
401
400
402
MEMORY
403
MULTI-VALUE IMAGE PROCESSING UNIT
404
LASER CONTROL UNIT
SUB IMAGE PROCESSING BOARD
500
502a
MEMORY G/A
501
502b
MEMORY
503a
503b
BINARY IMAGE PROCESSING UNIT
RDH G/A
HD
504a
SCSI G/A
504b
FAX I/F
SCSI-2
SCSI-2
601
304
A/D CONVERTING UNIT
LSU
PRINTER BOARD
602
ANALOGUE CIRCUIT
CCD G/A
303
302
CCD
301
CCD BOARD
300
406
FUNCTION EXPANDING BOARD
603
FACSIMILE BOARD
600

INFORMATION INPUT APPARATUS AND IMAGE FORMING APPARATUS

CROSS-NOTING PARAGRAPH

This non-provisional application claims priority under 35 U.S.C. §119(a) on Patent Application No. 2005-087881 filed in JAPAN on Mar. 25, 2005, the entire contents of which are hereby incorporated herein by reference.

FIELD OF THE INVENTION

The present invention relates to an information input apparatus and an image forming apparatus and, more specifically, to an information input apparatus that is equipped with a displaying unit to display an information input screen for inputting setting information of various functions, etc., and an image forming apparatus equipped with the information input apparatus.

BACKGROUND OF THE INVENTION

Conventionally, to facilitate operation and setting, an image forming apparatus such as a copying machine and a multi-function machine is equipped with a touch panel on the surface of a liquid crystal panel of the apparatus, and is adapted to display the state of the apparatus on the touch panel as necessary and be capable of being set for the operation of the apparatus, etc., by operating the touch panel according to the content of the display thereon. Among image forming apparatuses adapted as above, to provide specific settings, an image forming apparatus is equipped with a special mode (hereinafter, "simulation mode") for which operation method is not informed to the ordinary users, and is adapted to be capable of being set and adjusted for the apparatus by a service man having special knowledge. In this case, the operation mode of the apparatus has been switched to the simulation mode by a service man using a password set in the image forming apparatus previously, and settings are made and adjustment is executed for the apparatus. By using different passwords in response to the degree of difficulty of the setting or the adjustment, unprepared changes made to the settings of the apparatus are prevented.

FIG. 8 shows an example of a screen of user settings displayed on a touch panel of an image forming apparatus. The screen of the user settings includes, for example, indication of the total number of sheets of paper used, the screen contrast, data list print, settings of date and time, settings of feeding trays, registration of addressees, key operator programs, etc., and, in this example, the state where the items for the key operator programs are selected is shown.

FIGS. 9 and 10 show an example of an authentication information input screen to cause a setting screen of the key operator programs to be displayed on the touch panel of the image forming apparatus. An operator such as a service man inputs a key operator code that is authentication information, into this authentication information input screen using ten keys equipped to the image forming apparatus. When this authentication is successfully completed, the image forming apparatus displays a setting screen of key operator programs shown in FIG. 11 below.

FIG. 11 shows an example of a screen of key operator programs displayed on the touch panel of the image forming apparatus. The screen of the key operator programs includes setting items such as, for example, division administration, energy-saving settings, operation settings, device settings, system administration settings, copy settings, fax/image transmission settings, list/report print, key operator code change, product key input, etc. In this example, a state where the item of "device settings" is selected is shown. As described above, the operator who has been successfully authenticated on the authentication information input screen shown in FIGS. 9 and 10 can make various settings to the key operator programs shown in FIG. 11.

FIG. 12 shows an example of a screen of device settings displayed on the touch panel of the image forming apparatus. The screen of device settings includes items such as, for example, settings of an original script detecting apparatus (including items such as prohibition of use of a double-side copying function, prohibition of use of a mail bin stacker, prohibition of use of an original script feeder, prohibition of use of a paper sheet feeding desk, etc.) and security settings. In this example, a state where the item of "security settings" is selected is shown.

Relating to an apparatus that can be inputted with character information from a touch panel, apparatuses for which improvement of the operability is facilitated by adapting the apparatuses to be able to execute inputting with characters by causing a virtual keyboard to be displayed on a touch panel, are disclosed in, for example, Japanese Laid-Open Patent Publication Nos. H11-133816, 2000-108453, and 2004-38407. Setting information including characters can be inputted using a virtual key board according to Japanese Laid-Open Patent Publication Nos. H11-133816 and 2000-108453, and characters can be inputted using a virtual key board according to Japanese Laid-Open Patent Publication No. 2004-38407. All of these applications disclose apparatuses that are adapted to improve the operability of the apparatus for inputting by using a virtual key board.

The password to be inputted from the touch panel, needed when the operation mode is switched to the simulation mode described above, is often inputted by simultaneously pressing down a plurality of keys or as digits using ten keys. Therefore, even an ordinary user can get to know easily the password through attending the work of the service man. When an ordinary user gets to know the password for switching the mode to the simulation mode for making special settings as described above, if the user makes settings carelessly resulting in malfunctions of an apparatus, or if the user changes important settings such as those concerning the security of the apparatus, problems such as leak of data will arise. This can not be solved by the inventions described in the above Japanese Laid-Open Patent Publication Nos. H11-133816, 2000-108453, and 2004-38407.

SUMMARY OF THE INVENTION

An object of the present invention is, in an information input apparatus including a displaying unit that displays an information input screen for inputting various types of information and an input instructing unit that executes an input instruction from an input region provided on the information input screen, to display in the input region on the information input screen, information different from information previously assigned to the input region or nothing.

That is, the object of the present invention is to provide an information input apparatus including a displaying unit, such as a liquid crystal display, that displays an information input screen for inputting various types of information, and an input instructing unit that executes an input instruction from an input region (virtual keys) provided on the information input screen such as a touch panel, and capable of improving the confidentiality of the password for the apparatus by adapting the apparatus to be inputted with authentication information (password) using the virtual keys without being inputted with the password from the ordinary ten keys, etc., when the operation mode of the apparatus is switched to a special mode such as, for example, a simulation mode. More specifically, the apparatus is adapted in such a manner that the virtual keys for inputting password display information different from information assigned previously to the virtual keys or nothing.

Another object of the present invention is to provide an information input apparatus including a displaying unit that displays an information input screen for inputting various types of information, and an input instructing unit that executes an input instruction from an input region provided on the information input screen, wherein the displaying unit displays, in the input region on the information input screen, information different from information previously assigned to the input region.

Another object of the present invention is to provide the information input apparatus wherein the displaying unit displays, in the input region on the information input screen, information different from information displayed in the input region for the previous time.

Another object of the present invention is to provide the information input apparatus wherein the displaying unit can display an authentication information input screen for inputting authentication information set in the information input apparatus before displaying a setting information input screen for predetermined functions and displays, in the input region on the authentication information input screen, information different from information previously assigned to the input region.

Another object of the present invention is to provide an information input apparatus including a unit that permits an operation input to the information input apparatus when an input region corresponding to the authentication information is designated on the authentication information input screen, wherein the setting information input screen of the predetermined functions is displayed after the operation input has been permitted.

Another object of the present invention is to provide an information input apparatus including a displaying unit that displays an information input screen for inputting various types of information, and an input instructing unit that executes an input instruction from an input region provided on the information input screen, wherein the displaying unit displays nothing in an input region on the information input screen.

Another object of the present invention is to provide the information input apparatus wherein the displaying unit displays, on the information input screen, mode information indicating a setting state of the information input apparatus, and a cancellation key for canceling a mode of the mode information.

Another object of the present invention is to provide the information input apparatus wherein the displaying unit displays a frame indicating an input region on the information input screen.

Another object of the present invention is to provide the information input apparatus wherein the displaying unit can display an authentication information input screen for inputting authentication information set in the information input apparatus before displaying a setting information input screen of predetermined functions and displays nothing in the input region on the authentication information input screen.

Another object of the present invention is to provide the information input apparatus including a unit that permits an operation input to the information input apparatus when an input region corresponding to the authentication information is designated on the authentication information input screen, wherein the setting information input screen of the predetermined functions is displayed after the operation input has been permitted.

Another object of the present invention is to provide the information input apparatus wherein the input instructing unit is constructed by a touch panel that can input a coordinate position of an input region on the information input screen.

Another object of the present invention is to provide an image forming apparatus including the information input apparatus described above.

BRIEF DESCRIPTION OF THE DRAWINGS

FIG. 2 is a block diagram showing an example of the internal configuration of the image forming apparatus shown in FIG. 1;

PREFERRED EMBODIMENTS OF THE INVENTION

Figure 1:
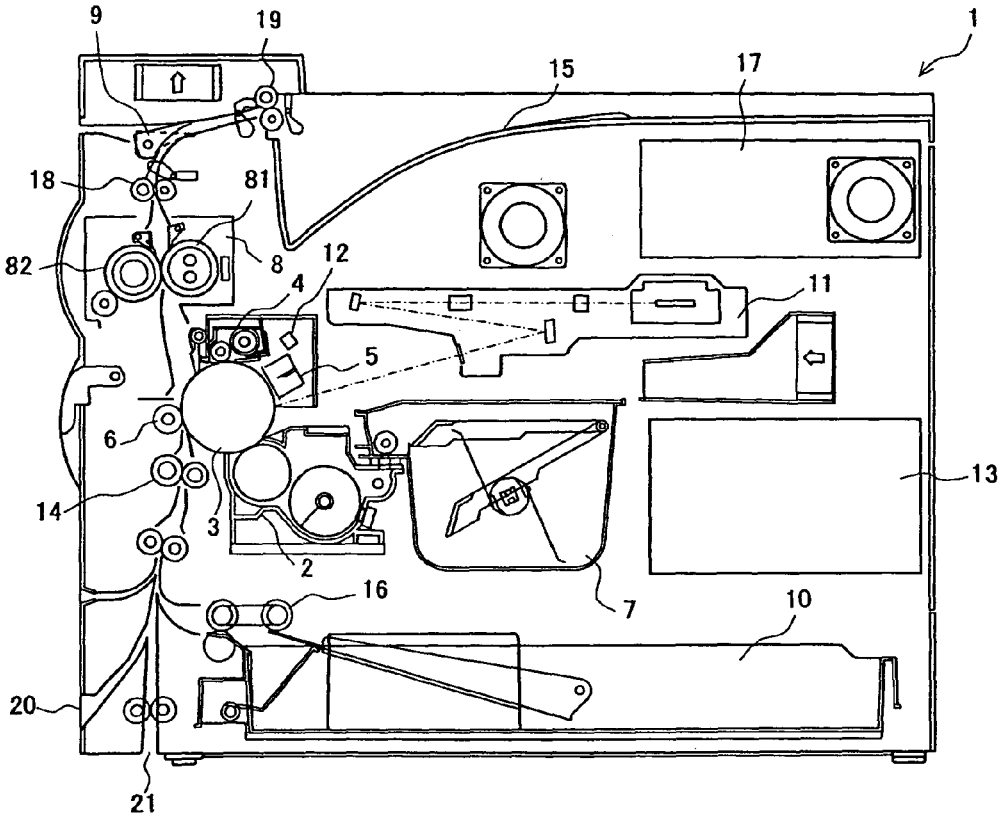
FIG. 1 shows an example of the configuration of an image forming apparatus applied with the present invention.

FIG. 1 shows an example of the configuration of an image forming apparatus applied with the present invention and a numeral "1" denotes the image forming apparatus. The image forming apparatus 1 records and outputs images read using an image reading apparatus and, data from an apparatus (for example, an image processing apparatus such as a personal computer) connected externally with the image forming apparatus 1, as images. The image forming apparatus 1 is disposed with processing units therein that surround a photo-sensitive drum 3 in the center of the units and execute the respective functions of an image forming process, and an image forming unit is formed by these units and the drum 3. Around the photo-sensitive drum 3, a charging unit 5, a photo-scanning unit 11, a developing unit 2, a transferring unit 6, a cleaning unit 4, an antistatic lamp 12, etc., are disposed one after another.

The charging unit 5 electrically charges the surface of the photo-sensitive drum 3 uniformly. The photo-scanning unit 11 writes an electrostatic latent image on the photo-sensitive drum 3 that has been uniformly charged, by scanning the photo-sensitive drum 3 drawing a photo image. The developing unit 2 develops the electrostatic latent image written by the photo-scanning unit 11 into a manifest image using a developing agent supplied by a developing agent charging tank 7. The transferring unit 6 transfers the image made manifest on the photo-sensitive drum 3 onto a recording material. The cleaning unit 4 removes the developing agent remained on the photo-sensitive drum 3 and enables a new image to be recorded on the photo-sensitive drum 3. The antistatic lamp 12 removes the charge on the surface of the photo-sensitive drum 3.

A feeding tray 10 internally equipped in the main body of the image forming apparatus 1 is disposed in the lower portion of the image forming apparatus 1. The feeding tray 10 is a recording material containing tray that contains the recording material (sheets). The sheets contained in the feeding tray 10 are separated one by one by a pick-up roller 16, etc., conveyed to a resist roller 14, and supplied sequentially between the transferring unit 6 and the photo-sensitive drum 3 by the resist roller 14 at a timing measured in terms of the images formed on the photo-sensitive drum 3. The image recorded and reproduced on the photo-sensitive drum 3 is transferred onto a sheet. When refilling of sheets into the feeding tray 10 is carried out, the feeding tray 10 is drawn out toward the front side (the side for operation) of the image forming apparatus 1.

A sheet inlet 21 that receives the sheets from a recording material feeding apparatus, not shown, having a multi-layer recording material feeding tray and prepared as a peripheral apparatus, and an additional recording material receiving unit 20 that receives sheets fed from another recording material feeding apparatus, not shown, capable of containing a large number of sheets, are provided in the bottom portion of the image forming apparatus 1. The sheets are fed sequentially toward the image forming unit from the sheet inlet 21 or the additional recording material receiving unit 20.

A fixing apparatus 8 is disposed in the upper portion of the image forming apparatus 1. The fixing apparatus 8 receives sequentially the sheets on which images are respectively transferred, and fixes the developed images that have been transferred on the sheets with heat and pressure by a fixing roller 81, a pressurizing roller 82, etc. Thereby, the images are recorded on the sheets.

The sheet with an image recorded thereon is further conveyed upward by a conveying roller 18 and passes through a switching gate 9. When an ejecting tray for the sheet is set in a loading tray 15 equipped in the exterior of the image forming apparatus 1, the sheet is ejected into the loading tray 15 by a reversing roller 19. On the other hand, when double-side image forming or post processes are specified, the sheet is once ejected toward the loading tray 15 by the reversing roller 19. In this case, the sheet is not completely ejected and the reversing roller 19 is rotated reversely pinching the sheet. The sheet is conveyed reversely in an opposite direction, that is, a direction toward a recording material re-feeding and conveying apparatus and a post-processing apparatus, both not shown, that are selectively attached respectively for double-side image forming and post-processes.

At this point, the switching gate 9 is switched to change the state from a state represented by a solid line to a state represented by a dotted line shown in FIG. 1. When double-side image forming is carried out, the sheet reversely conveyed passes through the recording material re-feeding and conveying apparatus and is fed again to the image forming apparatus 1. When post-processes are carried out, the sheet is conveyed passing another switching gate from the recording material re-feeding and conveying apparatus through a relay conveying apparatus to the post-processing apparatus, and the post-processes are carried out.

A controlling unit 17 that contains a circuit board for controlling the image forming process, an interface board for receiving image data from an external apparatus, etc., a power supplying apparatus 13 that supplies power respectively to various components such as the above interface board and the above image forming processing units, etc., are disposed in the spaces above and under the photo-scanning unit 11.

FIG. 2 is a block diagram showing an example of the internal configuration of the image forming apparatus 1 shown in FIG. 1. FIG. 2 shows that the image forming apparatus 1 (hereinafter, "digital copying machine 1") is constituted of various units, image processing units, etc., and the state where the operation of the digital copying machine 1 is administered by a main central processing unit 401 (CPU 401) positioned approximately in the center, communicating with sub central processing units (CPU 101, CPU 201, etc.) respectively mounted to the units.

As can be seen from this FIG. 2, the digital copying machine 1 is roughly constituted of an operation panel board 100 (approximately in upper right in FIG. 2) that administers and controls an operation panel; a machine control board 200 (approximately in upper left in FIG. 2) that administers and controls each unit constituting the digital copying machine 1; a CCD board 300 (approximately in lower left in FIG. 2) that reads electrically an original script image and converts the read image into electronic data; a main image processing board 400 (approximately in the center of FIG. 2) that executes a predetermined image process to the original script image that has been converted into electronic data by the CCD board 300; a sub image processing board 500 that further executes a predetermined image process to the image information processed by the main image processing board 400; and a group of other expansion boards 600 (approximately in lower right in FIG. 2: a printer board 601, a function expanding board 602, a facsimile board 603, etc.) connected through an interface with the sub image processing board 500.

The content administered and controlled by the boards will be described for each board.

(Operation Panel Board)

The operation panel board 100 is basically controlled by the sub CPU 101 and administers a display screen of an LCD displaying unit 104 disposed on an operation panel 103 and operation inputs from a group of operation keys 105 for inputting instructions relating to various modes.

This operation panel board 100 is provided with a memory 102 that stores various control information at the operation panel 103 such as data inputted from the group of operation keys 105 and information to be displayed on an LCD screen. In this configuration, the sub CPU 101 communicates with the main CPU 401 about control data and instructs operation of the digital copying machine 1.

The state of the operation is displayed to an operator through the LCD screen 104 of the operation panel 103, showing how the state of the apparatus is, by transferring a control signal representing the state of the operation of the digital copying machine 1 from the main CPU 401 to the sub CPU 101.

(Machine Control Board)

The machine control board 200 is wholly controlled by the sub CPU 201 and administers a memory 202 that stores various control information; an automatic original script feeding apparatus 203 such as an ADF/RADF, etc.; a reading scanner unit 204 that reads an image of an original script; a processing unit 205 that reproduces the image information as images; a sheet feeding and conveying unit 206 that conveys sequentially sheets of paper to be recorded with images thereon from a containing unit to a processing unit; a double-side recording path unit 207 that reverses and conveys a sheet of paper such that the sheet of paper recorded with an image on one side is reversed and images are formed on both sides of the sheet; a finisher 208 that executes post-processes such as stapling to the sheet recorded with images thereon, etc.

(CCD Board)

A CCD board 300 is constituted of a CCD 301 that reads electrically images of original scripts, a circuit (CCD gate array) 302 that drives the CCD 301, an analogue circuit 303 that adjusts the gain of analogue data outputted from the CCD 301, an A/D converting unit 304 that converts an analogue output of the CCD 301 into a digital signal and outputs the digital signal as electronic data, etc.; and is controlled and administered by the main CPU 401.

(Main Image Processing Board)

The main image processing board 400 is controlled by the main CPU 401 and is constituted of a multi-value image processing unit 402 that processes multi-value image data as they are such as a shading correction, a grey correction, a region separation, a filtering process, an MTF correction, resolution conversion, electronic zooming (variable power process), a gamma correction, etc., based on the electronic data of the image of the original script sent from the CCD board 300 such that the gradation of the image can be shown in a desired condition; a memory 403 that stores various control information such as the image data that have been applied with the processes or the procedure administration of the processes; a laser control unit 404 that controls transfer of the data to the side of a laser writing unit (LSU) 406 to reproduce the images using the image information that has been applied with the processes; etc.

(Sub Image Processing Board)

The sub image processing board 500 is connected with the main image processing board 400 through connectors (connectors 405 and 505), and is constituted of a binary image processing unit 501; a memory 502*b* that stores and administers binary image information applied with image processes or control information for processing, and a gate array 502*a* that controls the memory 502*b*; a hard disk 503*b* that stores and administers image information of original scripts for a plurality of sheets and produces a plurality of copies by reading the images of the original scripts for a plurality of sheets repeatedly for as many the number of times as a desired number of copies, and a gate array 503*a* that controls the hard disk 503*b*; an SCSI 504*b* as an external interface and a gate array 504*a* that controls the SCSI 504*b*; etc., all of which are controlled by the main CPU 401 on the main image processing board 400.

The binary image processing unit 501 described above is constituted of a processing unit that converts the multi-value image information into a binary image, a processing unit that rotates an image, a binary variable power (zooming) processing unit that executes variable power process of a binary image, etc., and is further equipped with a facsimile (FAX) interface to be able to transmit and receive facsimile images through a communication unit.

(Expansion Board)

As the expansion boards 600, a printer board 601 that enables data sent from a personal computer, etc., to be outputted from a printer unit of the digital copying machine as data in a printer mode, a function expanding board 602 that effectively utilizes the features of the digital copying machine by expanding the editing function of the digital copying machine, a facsimile (FAX) board 603 that enables the image of the original script read from a scanner unit of the digital copying machine to be transmitted to an addressee and image information sent from an addressee to be outputted from the printer unit of the digital copying machine, can be listed. As the image processing functions of the digital copying machine, processing of image data and the flow of image data as a copy mode, a facsimile mode, and a printer mode will be described more specifically below.

(Copy Mode)

Original scripts set at a predetermined position of the RADF 203 of the digital copying machine 1 are sequentially fed one by one onto a script loading base of the reading scanner unit 204. The images of the original scripts are read sequentially by the structure of the reading scanner unit 204 and are transferred to the main image processing board 400 as eight-bit electronic data. The eight-bit electronic data transferred to the main image processing board 400 are applied with predetermined processes in the multi-value image processing unit 402 as eight-bit electronic image data.

The eight-bit electronic image data are applied with processes such as the gamma correction and are sent to the laser writing unit 406 through the laser control unit 404. Thereby, the images of the original scripts read by the reading scanner unit 204 of the digital copying machine 1 are outputted from the LSU 406 as copy images having gradation.

(Electronic RDH Function in the Copy Mode)

Similarly, original scripts set at a predetermined position of the RADF 203 of the digital copying machine 1 are sequentially fed one by one onto a script loading base of the reading scanner unit 204. The images of the original scripts are read sequentially by the structure of the reading scanner unit 204 and are transferred to the main image processing board 400 as eight-bit electronic data. The eight-bit electronic data transferred to the main image processing board 400 are applied with predetermined processes on the multi-value image processing unit 402 as eight-bit electronic image data.

The eight-bit electronic image data are sent from the connector 405 on the side of the main image processing board 400 through the connector 505 on the side of the sub image processing board 500 to the side of the sub image processing board 500, and are applied with processes such as error diffusion in a multi-value-binary converting unit of the binary image processing unit 501 as well as are converted from the eight-bit electronic image data to two-bit electronic image data. Why the eight-bit electronic image data are converted into the two-bit electronic image data together with the application of the processes such as the error diffusion is that care is taken so that the degradation of the image quality is reduced because problems in terms of image quality are arisen when only multi-value-binary conversion is executed to the eight-bit electronic image data.

Why the eight-bit electronic image data are converted into the two-bit electronic image data is that the storage capacity for the images is taken into account. The two-bit electronic image data converted as described above are transferred to the hard disk 503*b* for each one of the original scripts, and are temporarily stored and administered in the hard disk 503*b*. When all of the original scripts set in the RADF 203 of the digital copying machine 1 are read and processed, the two-bit electronic image data previously stored temporarily in the hard disk 503*b* are read repeatedly for as many the number of times as a desired number of copies designated by the control of the gate array 503*a*. The read two-bit electronic image data are sent again through the connectors 405 and 505 to the main image processing board 400, are applied with processes such as the gamma correction, and are sent through the laser control unit 404 to the LSU 406.

It has been described that the images are read for as many the number of times as a desired number of copies after all of the original script images have been read. However, an image output for a first copy can also be adapted to be outputted sequentially when images for the predetermined copies have been prepared. Thereby, the images of the original scripts read by the reading scanner unit 204 of the digital copying machine 1 are outputted from the LSU 406 as copy images having gradation.

(Printer Mode)

Images sent from an external apparatus connected through a network such as a personal computer are displayed as images in pages on the printer board 601. Thereafter, the images are once transferred from the SCSI 504*b* that is an interface, to side of the sub image processing board 500 and are stored in a memory such as the hard disk 503*b*, etc. The images displayed on the printer board 601 as page images are sent to the side of the sub image processing board 500. However, the page images are not applied with the binary image process and are only stored temporarily in the hard disk 503*b*.

Similarly, when the page images that have been once stored are read from the hard disk 503*b*, the page images are not applied with the binary image process. The image information stored temporarily in the hard disk 503*b* are read from the hard disk 503*b* such that the predetermined order of pages are followed, while the image information is sent to the main image processing board 400 and is applied with the gamma correction and writing of the images are controlled from the laser control unit 404 such that the images are reproduced at the LSU 406.

(Facsimile Mode)

In the facsimile mode, processes for transmission of original scripts to an addressee and reception of original scripts from the addressee are included. The transmission of original scripts to an addressee will be first described. Original scripts to be transmitted set at a predetermined position of the RADF 203 of the digital copying machine 1 are sequentially fed one by one onto a script loading base of the reading scanner unit 204. The images of the original scripts to be transmitted are read sequentially by the structure of the reading scanner unit 204 and are transferred to the main image processing board 400 as eight-bit electronic data.

The eight-bit electronic data transferred to the main image processing board 400 are applied with predetermined processes on the multi-value image processing unit 402 as eight-bit electronic image data. The eight-bit electronic image data are sent from the connector 405 on the side of the main image processing board 400 through the connector 505 on the side of the sub image processing board 500 to the side of the sub image processing board 500, and are applied with processes such as error diffusion in the multi-value-binary converting unit of the binary image processing unit 501 as well as are converted from the eight-bit electronic image data to two-bit electronic image data. Why the eight-bit electronic image data are converted into the two-bit electronic image data together with the processes such as the error diffusion is that care is taken so that the degradation of the image quality is reduced because problems in terms of image quality are arisen when only multi-value-binary conversion is executed to the eight-bit electronic image data.

The original scripts to be transmitted converted into the binary images as described above are compressed in a predetermined format and stored in the memory 502*b*. When a state where transmission is allowed is secured by completing the procedure for the transmission to the addressee, the images of the original scripts to be transmitted compressed in the predetermined format and having been read from the memory 502*b* are transferred to the side of the facsimile board 603, are applied with necessary processes such as change of the compression format on this facsimile board 603, and are transmitted sequentially through a communication line to the addressee.

Processes for images of original scripts transmitted from an addressee will be described.

When original scripts are transmitted through a communication line from an addressee, the communication procedure is executed on the facsimile board 603 while the images of the original scripts being transmitted from the addressee are received as well as the received images compressed in the predetermined format are sent from a facsimile interface provided to the binary image processing unit 501 on the sub image processing board 500 to the binary image processing unit 501 and the transmitted images of the original scripts are reproduced as page images by a compressing/expanding processing unit, etc.

The images of the original scripts reproduced as images in pages are transferred to the side of the main image processing board 400 and are applied with the gamma correction and writing of the images are controlled from the laser control unit 404 such that the images are reproduced at the LSU 406.

In FIG. 2, the information input apparatus of the present invention is constituted of the operation panel board 100 and the operation panel 103. The operation panel 103 has the LCD 104 that is equipped integrally with the touch panel that is the input instructing unit for inputting a coordinate position of an input region provided on the screen, and displays the information input screen for inputting various types of information into this LCD 104. The control of the display of this LCD 104 is executed by the operation panel board 100. The touch panel on the LCD 104 is provided with an input region (virtual keys) for inputting setting information and authentication information, etc., of various functions and input of information is enabled by pressing the corresponding virtual keys by an operator.

In the present invention, the LCD 104 displays on the corresponding virtual keys information different from information previously assigned to the virtual keys on the touch panel. For example, number information (ten keys), character information (including alphabetical keys, character keys, symbol keys, etc.), etc., are previously assigned to the virtual keys for inputting the authentication information. However, information different from this assigned information is displayed. An operator (for example, a service man, etc.) of the digital copying machine 1 grasps previously the relation between information that the operator desires to input and the virtual keys on the touch panel, and designates a virtual key (with, for example, "five" displayed thereon) corresponding to the information that the operator desires to input (for example, "one") by pressing the virtual key. Thereby, the service man can input "one" that is the desired information. However, the inputted information "one" is not leaked to those around because "five" is displayed on the virtual key. The information to be displayed on this virtual key may be any information that is different from the above "one" and may be a character, an alphabet, a symbol, etc.

As another embodiment, nothing may be displayed on the virtual keys on the touch panel. Similarly, in this case, for example, number information (ten keys), character information (including alphabetical keys, character keys, symbol keys, etc.) are previously assigned to the virtual keys. The operator (service man) of the digital copying machine 1 grasps previously the relation between information that the operator desires to input and the virtual keys on the touch panel, and designates a virtual key (with nothing displayed thereon) corresponding to the information that the operator desires to input (for example, "one") by pressing the virtual key. Thereby, the service man can input "one" that is the desired information. However, the inputted information "one" is not leaked to those around because nothing is displayed on the virtual key.

Figure 3:
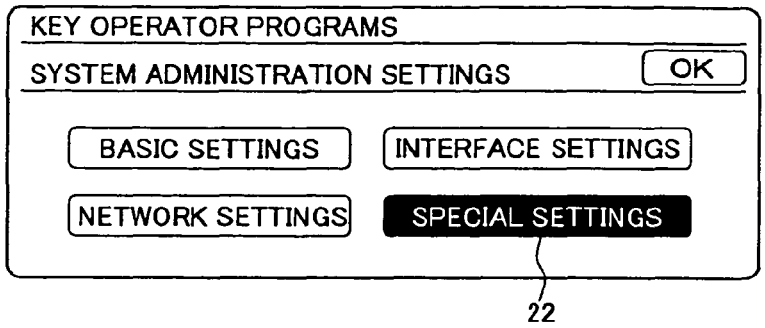
FIG. 3 shows an example of an information input screen displayed on an LCD.
Figure 11:
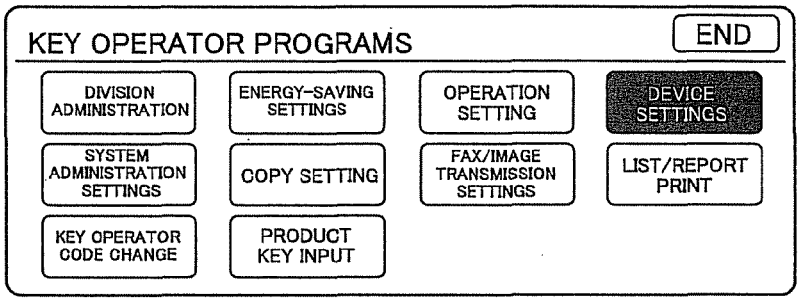
FIG.11 PRIOR ART
FIG. 11 shows an example of a screen of the key operator programs displayed on the touch panel of the image forming apparatus.
Figure 12:
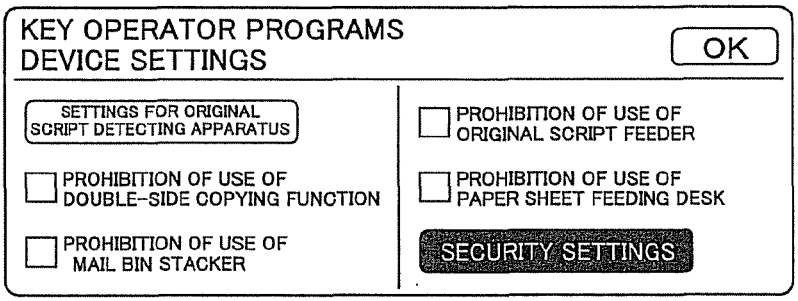
FIG.12 PRIOR ART
FIG. 12 shows an example of a screen of device settings displayed on the touch panel of the image forming apparatus.

FIG. 3 shows an example of an information input screen displayed on the LCD 104. This example shows a state where a system administration setting screen of the key operator programs (see FIG. 11 described above) is displayed. The system administration setting screen has, for example, four virtual keys for executing basic settings, interface settings, network settings, special settings, etc. At this point, the service man selects a virtual key 22 on which "special settings" is displayed. The operation of a mode for making this special settings is not informed to ordinary users because specific settings for the apparatus are made in this mode. Usually, an authentication process is executed using a password, etc., when the operation mode is switched to this mode. As described above, when the virtual key 22 for the special settings is selected by pressing the virtual key 22, an input screen for authentication information (password) in each example shown respectively in FIGS. 4 to 6 below is displayed.

Figure 4:
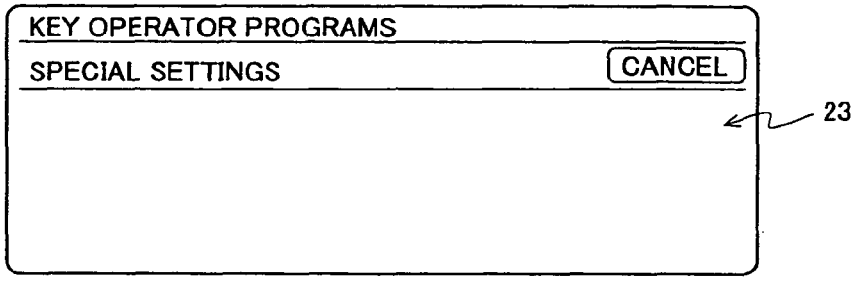
FIG. 4 shows an example of an input screen of a password displayed on the LCD.

FIG. 4 shows an example of an input screen for a password displayed on the LCD 104. In this example, only mode information indicating the state of settings of the apparatus (the special settings in this example) and a cancellation key to cancel the mode of the mode information are displayed on the LCD 104 and nothing is displayed on a virtual key 23 (a plurality of virtual keys are present practically) that is for inputting the password. In this case, the service man grasps previously the position (for example, upper right, center, lower left, etc.) of the virtual key corresponding to the information that the service man desires to input and designates the virtual key (in upper right in this case) corresponding to the information desired to input, (for example, "one") by pressing the virtual key. The number of digits and form (digit, alphabet, symbol, character, and combinations thereof) of the password can be set optionally.

Figure 5:
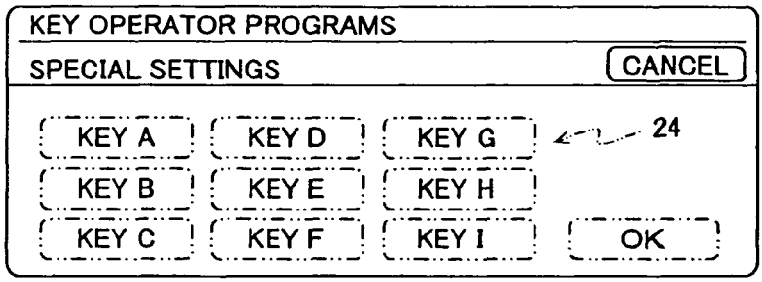
FIG. 5 shows another example of the input screen of the password displayed on the LCD.

FIG. 5 shows another example of the input screen of the password displayed on the LCD 104. In this example, information different from information previously assigned to a virtual keys 24 on the touch panel is displayed on the virtual keys 24. For example, "Key A" to "Key I" are respectively displayed on the virtual keys 24. However, the information assigned previously to the virtual keys 24 is assumed to be number information of "1" to "9". The service man grasps previously the relation between the information that the service man desires to input ("1" to "9") and the virtual keys 24, and designates a virtual key (in this example, "Key A") corresponding to the information desired to input (in this example, "1") by pressing the virtual key.

Information different from the information that has been displayed in the previous time may be displayed on the virtual keys 24. For example, assuming that the information displayed last time is "Key A" to "Key I", information (for example, "Key J" to "Key R", etc.) different from that information is displayed this time on the virtual keys 24 when some information is to be displayed this time. As described above, the confidentiality of the password can be more improved by changing the display of the virtual keys every time.

Figure 6:
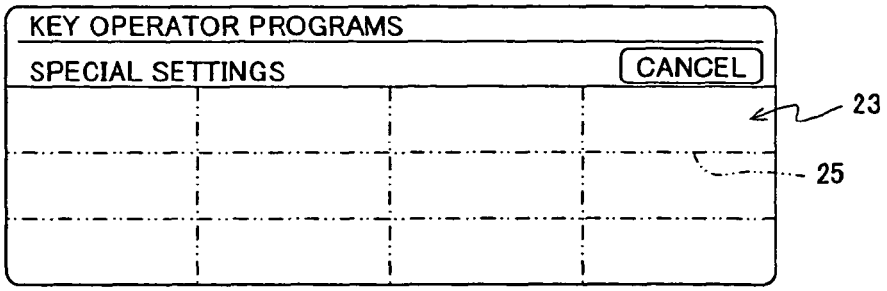
FIG. 6 shows another example of the input screen of the password displayed on the LCD.

FIG. 6 shows another example of the input screen of the password displayed on the LCD 104. In this example, a frame 25 indicating the virtual key 23 described above and shown in FIG. 4 is displayed on the virtual key 23 and nothing is displayed on the virtual key 23 that is for inputting the password. In this case, the service man grasps previously the position (for example, the first row of the second column, etc.) of a virtual key corresponding to the information that the service man desires to input and designates a virtual key (in this example, the first row of the first column) corresponding to the information desired to input (in this example, "1") by pressing the virtual key. In this example, because the frame 25 indicating the virtual key 23 is displayed, an operator such as the service man can easily designate the virtual key. The frames in FIG. 6 are referred to as the first column, the second column, . . . from the left to the right in the drawing and the first row, the second row, . . . from the top to the bottom.

When a virtual key corresponding to a password is designated on the input screen, the digital copying machine 1 includes a unit that permits the operation input to the apparatus 1 and, after the operation input has been permitted, the setting information input screen for special settings, etc., is displayed. That is, the operation mode of the digital copying machine 1 is switched to a special setting mode and the service man can make the special settings to the digital copying machine 1. The above permission of the operation input is given by the operation panel board 100.

Figure 7:
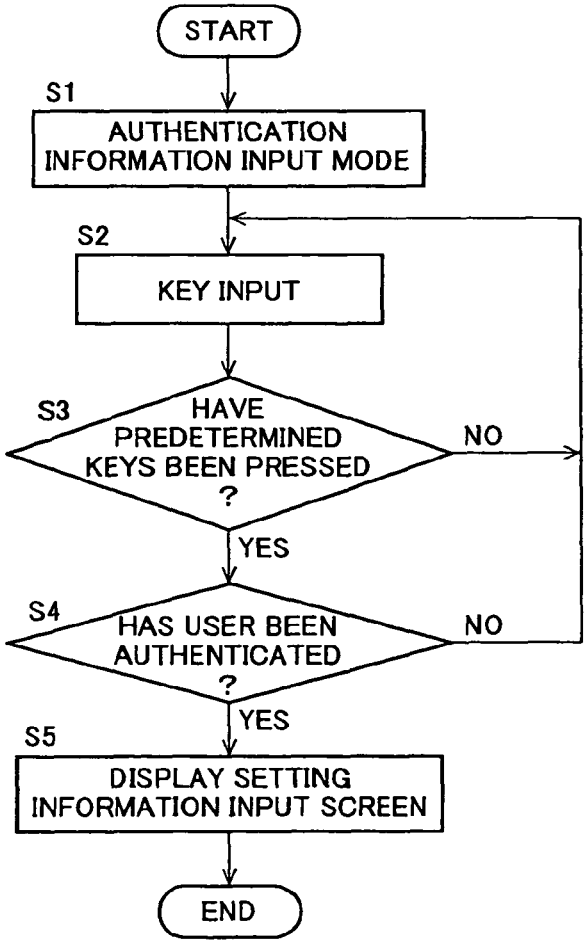
FIG. 7 is an explanatory flow diagram of an example of an information input method of a digital copying machine applied with the present invention.
Figure 8:
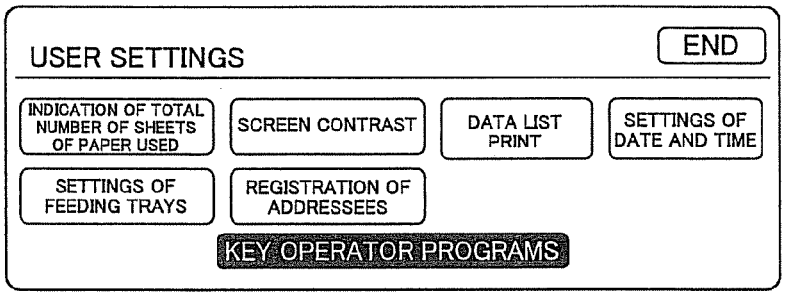
FIG.8 PRIOR ART
FIG. 8 shows an example of a screen of user settings displayed on a touch panel of the image forming apparatus.
Figure 9:
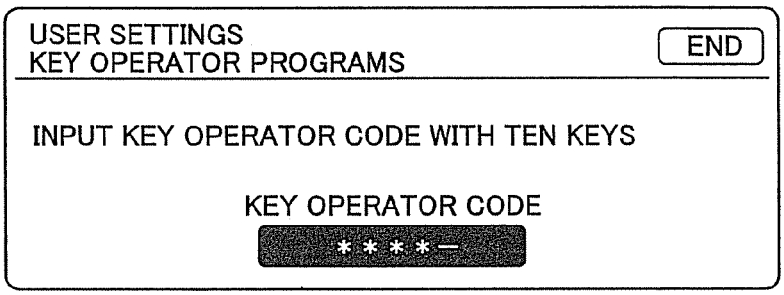
FIG.9 PRIOR ART
FIG. 9 shows an example of an authentication information input screen for displaying a setting screen of key operator programs on the touch panel of the image forming apparatus.
Figure 10:
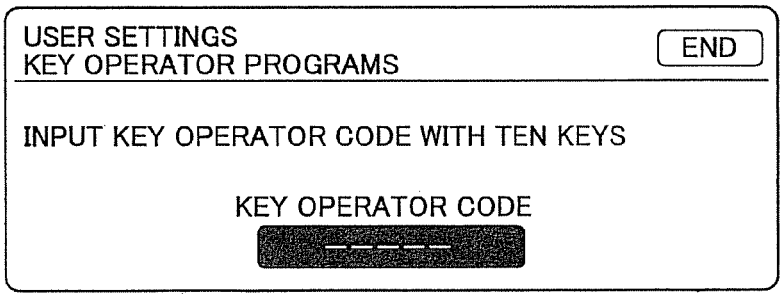
FIG.10 PRIOR ART
FIG. 10 shows another example of the authentication information input screen for displaying the setting screen of the key operator programs on the touch panel of the image forming apparatus.

FIG. 7 is an explanatory flow diagram of an example of an information input method of the digital copying machine 1 applied with the present invention. The service man presses a special setting key shown in FIG. 3, changes the mode to any one of the authentication information input modes shown in FIGS. 4 to 6 (step S1), and executes inputting from virtual keys (step S2). The digital copying machine 1 determines whether or not a predetermined key has been pressed (step S3). When the predetermined key has been pressed (the case of "YES"), user authentication is executed (step S4). When the authentication has been executed (the case of "YES"), the setting information input screen is displayed (step S5).

On the other hand, when the digital copying machine 1 determines that the predetermined key has not been pressed in the above step S3 (the case of "NO"), or when the user is not authenticated in the above step S4 (the case of "NO"), the operation of the digital copying machine 1 returns to the above step S2 and repeats the processes.

According to the present invention, effects as follows can be obtained.

An information input apparatus of the present invention and an image forming apparatus equipped with the information input apparatus are respectively equipped with a displaying unit such as a liquid crystal display, that displays an information input screen for inputting various types of information and an input instructing unit such as a touch panel, that executes an input instruction from an input region (virtual keys) provided on the information input screen and, when, for example, the operation mode of the apparatus is switched to a special mode such as a simulation mode, a password is inputted using virtual keys on a touch panel without inputting any authentication information (password) from ordinary ten keys, etc. In this case, information different from information assigned previously to the virtual keys for inputting the password is displayed on the virtual keys, or nothing is displayed on the virtual keys. Thereby, the confidentiality of the password is improved, the content of the operation can not be seen by ordinary users, and unprepared changes to the settings of the apparatus can be prevented.

The invention claimed is:

1. An information input apparatus, comprising:

a displaying unit that displays an information input screen for inputting various types of information through at least one virtual key, the at least one virtual key being a number, a character, or a symbol; and an input instructing unit that executes an input instruction from an input region provided on the information input screen, wherein upon selection of a special settings mode by an operator, the displaying unit automatically displays to the operator who continues to operate the information input apparatus, on the at least one virtual key in the input region on the information input screen, a different number, character, or symbol, without requiring intervention by the operator to display the different number, character, or symbol.

2. The information input apparatus according to claim 1, wherein the displaying unit displays, in the input region on the information input screen, information different from information previously displayed in the input region.

3. The information input apparatus according to claim 1, wherein the displaying unit can display an authentication information input screen for inputting authentication information set in the information input apparatus before displaying a setting information input screen for predetermined functions and displays, in the input region on the authentication information input screen, information different from information previously assigned to the input region.

4. The information input apparatus according to claim 3, including a unit that permits an operation input to the information input apparatus when an input region corresponding to the authentication information is designated on the authentication information input screen, wherein the setting information input screen of the predetermined functions is displayed after the operation input has been permitted.

5. The information input apparatus according to claim 1, wherein the input instructing unit is constructed of a touch panel that can input a coordinate position of an input region on the information input screen.

6. An image forming apparatus including the information input apparatus according to claim 1.

* * * * *